US010654648B1

(12) United States Patent
Rodriguez

(10) Patent No.: US 10,654,648 B1
(45) Date of Patent: May 19, 2020

(54) DEVICE TO OPEN AND CLOSE TRASH BIN CABINET DOORS IN SMALL SPACES

(71) Applicant: E WAY COLIBRI CORP., Hialeah, FL (US)

(72) Inventor: Julio Rodriguez, Miami, FL (US)

( * ) Notice: Subject to any disclaimer, the term of this patent is extended or adjusted under 35 U.S.C. 154(b) by 0 days.

(21) Appl. No.: 16/380,720

(22) Filed: Apr. 10, 2019

(51) Int. Cl.

| | |
|---|---|
| ***B65F 1/14*** | (2006.01) |
| ***A47B 77/18*** | (2006.01) |
| ***B65F 1/16*** | (2006.01) |
| ***B65F 1/02*** | (2006.01) |
| ***A47B 96/16*** | (2006.01) |
| ***A47B 77/10*** | (2006.01) |

(52) U.S. Cl.
CPC ..... *B65F 1/1436* (2013.01); *A47B 77/10* (2013.01); *A47B 96/16* (2013.01); *B65F 1/02* (2013.01); *B65F 1/1646* (2013.01); *A47B 77/18* (2013.01)

(58) Field of Classification Search
CPC ..... A47B 77/18; A47B 77/10; A47B 96/16; A47B 88/46; A47B 88/463; A47B 88/453; A47B 2210/0056; B65F 1/1436; B65F 1/1426; B65F 1/1607; B65F 1/646; B65F 1/16; B65F 1/02; B65B 7/1216; F24C 15/162
USPC ..... 312/311, 270.3, 212, 273, 274, 271, 312/330.1, 211, 310, 319.1, 298, 329; 220/815, 813, 812, 811, 810, 825, 263, 220/262, 908
See application file for complete search history.

(56) References Cited

U.S. PATENT DOCUMENTS 1,899,171 A * 2/1933 Warren ..... F25D 25/027 312/275
2,233,796 A * 3/1941 Pines ..... B65F 1/1436 248/128

(Continued)

FOREIGN PATENT DOCUMENTS

EP 1533253 A1 * 5/2005 ..... A47B 96/16

OTHER PUBLICATIONS

English translation for EP1533253 (Year: 2005).*

*Primary Examiner* — Hiwot E Tefera
(74) *Attorney, Agent, or Firm* — Sanchelima & Associates, P.A.; Christian Sanchelima; Jesus Sanchelima

(57) ABSTRACT

A trash collection apparatus useable in kitchens, bathrooms, bedrooms etc. is disclosed. The trash collection apparatus comprises a cabinet housing having sidewalls. The trash collection apparatus comprises a door hingedly mounted to a sidewall of the cabinet housing. The door comprises a frame member at the bottom. The trash collection apparatus comprises a bin support mounted to a spring member and the spring member is mounted to a rail provided at bottom of the cabinet housing. The bin support comprises a guiding assembly mounted to the frame member. The trash collection apparatus comprises a trash receptacle placed on the bin support and a lid hingedly mounted to the trash receptacle. The bin support carrying the trash receptacle is slidable along the rail with the help of the spring member. While the bin support is being slid, the lid is operated to provide access to the interior of the trash receptacle or to cover the trash receptacle and the door is operated between an open and closed position.

3 Claims, 10 Drawing Sheets

(56) References Cited

U.S. PATENT DOCUMENTS 2,247,232 A * 6/1941 Goldberg ..... B65F 1/1436 312/274
2,343,409 A * 3/1944 Goldberg ..... B65F 1/1436 312/274
2,361,525 A * 10/1944 Ball ..... A47B 96/16 312/274
2,518,985 A * 8/1950 Geyh ..... A47B 21/02 312/273
2,532,405 A * 12/1950 Jakeway ..... A47B 96/16 312/8.5
2,657,110 A * 10/1953 Feder ..... F24C 15/162 312/274
2,934,390 A * 4/1960 Wright ..... B01L 1/50 312/270.3
3,184,276 A * 5/1965 Billups ..... A47B 96/16 312/274
3,221,803 A * 12/1965 Lambert ..... E05D 15/262 160/206
3,895,849 A * 7/1975 Zehr ..... A62C 2/12 312/324
3,922,046 A * 11/1975 Schneider ..... B65B 67/1216 312/211
4,413,868 A * 11/1983 Gorkiewicz ..... A47B 96/16 248/282.1
5,005,729 A * 4/1991 Hollman ..... B65F 1/1436 220/23.83
5,215,363 A 6/1993 Warwick, III
5,474,374 A * 12/1995 Sandvig ..... A47B 77/18 312/271
5,634,702 A * 6/1997 Fistonich ..... A47B 77/18 312/270.3
6,702,411 B2 3/2004 Helver
2007/0018545 A1* 1/2007 Calabria ..... A47B 77/10 312/311
2008/0007147 A1* 1/2008 Skog ..... A47B 77/18 312/270.3
2009/0071963 A1* 3/2009 Johnson ..... A47B 77/18 220/476
2009/0212678 A1* 8/2009 Sung ..... A47B 77/18 312/333
2010/0253191 A1* 10/2010 Backhaus ..... A47B 96/16 312/309
2013/0002100 A1* 1/2013 Badri ..... B65F 1/1426 312/212

* cited by examiner

DEVICE TO OPEN AND CLOSE TRASH BIN CABINET DOORS IN SMALL SPACES

BACKGROUND OF THE INVENTION

1. Field of the Invention

The present invention generally relates to cabinet apparatuses such as a kitchen cabinet apparatus. More specifically, the present invention relates to a trash collection apparatus comprising a waste receptacle provided within a cabinet housing, the waste receptacle moves forward and opens a lid when a door of the cabinet housing is opened to collect waste.

2. Description of the Related Art

It is known that it is important to keep kitchen clean for cleanliness and hygiene purposes. Generally, garbage or waste in the kitchen is kept in containers such as tool bins, storage bags, waster paper baskets, hampers and similar items. The garbage in the containers is regularly cleared on daily basis or when the garbage becomes full in the containers. Typically, the containers or waste receptacles are placed in a corner of the kitchen. This may hinder people when moving around the kitchen or may become an obstruction when not being used.

In order to overcome above problem, the waste receptacles may be placed inside cabinets provided in the kitchen. This allows saving space in the kitchen. Further, placing the waste receptacle inside the cabinet may allow the people to move around without any obstruction. However, it is inconvenient for users to bend and access the waste receptacle to place the garbage or to clear the garbage from the waste receptacle.

In order to overcome the problem of bending to open a door of the cabinet to place the garbage in the waste receptacle placed inside the cabinet, several hands-free cabinet drawer assist systems have been proposed in the past. One such example is disclosed in a granted U.S. Pat. No. 5,215,363. In U.S. Pat. No. 5,215,363A, it is disclosed that an apparatus includes a container member slidably mounted between spaced parallel container support sidewalls, wherein the container support sidewalls are mounted within a cabinet housing. The container support includes a gear rack mounted from the container support to a rear wall of the container member, and further includes a lid control cable extending from the container member to the lid directed through cooperative pulleys to effect simultaneous opening of the lid upon projection of the container member exteriorly of the cabinet housing relative to the spaced container support side wall.

Another example is disclosed in a United States patent application 20130002100. In US20130002100A1, an apparatus for use in a cabinet is disclosed. The cabinet has a front carrying a door. The apparatus comprises a shuttle that mounts to the cabinet. A bin, having an upper rim and an axis, moves with the shuttle, when said door is open, between a storage position inside the cabinet and an access position outside the cabinet. When the bin is in the storage position, the axis is parallel to the front and adjacent that part of rim that is furthest from the front. The lid has a closed position associated with the storage position whereat the lid occludes the bin and an open position associated with the access position whereat the lid projects upwardly from the axis to permit egress to the bin. The mechanism causes the lid to move between the closed and open positions as the bin is moved between the storage and access positions.

Another example is disclosed in a granted U.S. Pat. No. 6,702,411. In U.S. Pat. No. 6,702,411B2, it is disclosed that a waste receptacle or other household items are placed upon a movable shelf or drawer under the counter in a space covered by an openable door. The shelf or drawer is movable between a first, retracted, mounted position stowed within the cabinet and a second, deployed, position removed from the cabinet. The user can withdraw the shelf or drawer hands-free from the cabinet and place items within the waste receptacle or drawer by simply opening the cabinet door. To stow the tray or drawer, the user simply pushes the tray or drawer back within the cabinet, into the retracted position. A novel latch assembly retains the drawer or tray, and, hence the receptacle or other item(s), in the retracted position, and the door can be closed to conceal the same. Upon closing the door, a lever attached to the door causes the latch mechanism to unlatch, releasing the drawer, which then abuts against the cabinet door. Means may be provided for retaining the cabinet door in its closed position until the user desires to access the waste receptacle or drawer. Then, the user simply opens the door, causing the tray or drawer to be automatically deployed by a biasing mechanism.

Another example of "Automatic self opening garbage bin trash" is disclosed in a non-patent literature, with hyperlink https://www.youtube.com/watch?v=VI6s9M6lkGk.

Although the above devices are useful in opening and closing the cabinet doors to access the waste receptacle placed inside the cabinet, they have a few problems. Some of the devices discussed above require a user to manually operate the waste receptacle to slide outside or inside the cabinet. Further, the existing waste receptacle or other household items that are placed upon a movable shelf or drawer, which have complex constructional features. This may hinder sliding mechanism of the movable drawer. Further, the lid of the waste receptacle may have to be opened manually, which may cause inconvenience to the user.

Other documents describing the closest subject matter provide for a number of more or less complicated features that fail to solve the problem in an efficient and economical way. None of these patents suggest the novel features of the present invention. Specifically, none of the disclosures in the art discloses a trash collection apparatus comprising a waste receptacle provided within a cabinet housing, the waste receptacle is configured to move forward and open a lid when a door of the cabinet housing is opened to collect waste and to retrieve to its original position while closing the lid and closing the door simultaneously. Additionally, the present invention makes uses of any available space. Pipes or drainage systems that can be found inside cabinets do not prohibit the present invention from being installed properly.

Therefore, there is a need in the art for a trash collection apparatus comprising a waste receptacle provided within a cabinet housing, the waste receptacle is configured to move forward and open a lid when a door of the cabinet housing is opened to collect waste and to retrieve to its original position while closing the lid and closing the door simultaneously.

SUMMARY OF THE INVENTION

It is one of the main objects of the present invention to provide a trash collection apparatus comprising a waste receptacle provided within a cabinet housing and that avoids the drawbacks of the prior art.

It is one object of the present invention to provide a trash collection apparatus comprising a waste receptacle provided within a cabinet housing. The waste receptacle is configured to move forward and open a lid when a door of the cabinet housing is opened to collect waste and to retrieve to its original position while closing the lid and closing the door simultaneously.

It is one object of the present invention to provide a trash collection apparatus that can be used in kitchens, bathrooms, bedrooms, etc. The trash collection apparatus comprises a cabinet housing having sidewalls. The trash collection apparatus comprises a door hingedly mounted to a sidewall of the cabinet housing. The door comprises a frame member at the bottom. The trash collection apparatus further comprises a bin support mounted to a spring member and the spring member is mounted to a rail provided at bottom of the cabinet housing. The bin support further comprises a guiding assembly mounted to the frame member of the door. The trash collection apparatus further comprises a trash receptacle placed on the bin support and a lid hingedly mounted to the trash receptacle. The bin support carrying the trash receptacle is slidable along the rail with the help of the spring member. While the bin support is being slid, the lid is operated to provide access to interior of the trash receptacle or to cover the trash receptacle and the door is operated between open and closed position.

It is one object of the present invention to provide a trash collection apparatus comprising a cabinet housing having a cabinet bottom, sidewalls and a counter top. One of the sidewalls comprises a track. The trash collection apparatus comprises a door mounted to the cabinet housing at the sidewall. The door comprises a frame member. The trash collection apparatus further comprises a bin support mounted to at least one spring member. The least one spring member is mounted to a rail provided at the cabinet bottom. The at least one spring member facilitates in extending and contracting the length of the bin support. The bin support comprises a guiding assembly mounted to the frame member provided at the door. The trash collection apparatus further comprises a trash receptacle placed on the bin support and a lid mounted to the trash receptacle. The lid comprises a support arm having a roller. The roller is placed on the track provided at the sidewall of the cabinet housing.

The bin support is slidable along the rail with the help of the one spring member such that the trash receptacle is slid along with the bin support.

When the bin support carrying the trash receptacle is slid away from the cabinet housing, the roller is made to travel over the track in order to raise the lid to provide access to interior of the trash receptacle, and the guiding assembly pushes the door from closed position to open position in order to provide access to the trash receptacle.

When the bin support carrying the trash receptacle is slid into the cabinet housing, the roller is made to travel over the track to lower the lid in order to cover the trash receptacle, and the guiding assembly pulls the door from open position to closed position.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art and is not intended to limit the invention to the explicit disclosure, as one or ordinary skill in the art will understand that variations can be substituted that are within the scope of the invention as described.

The present disclosure discloses a trash collection apparatus that can be used in kitchens, bathrooms, bedrooms, etc. The trash collection apparatus comprises a cabinet housing having sidewalls. The trash collection apparatus comprises a door hingedly mounted to one of the sidewalls of the cabinet housing. The door comprises a frame member at the bottom. The trash collection apparatus comprises a bin support mounted to a spring member and the spring member is mounted to a rail provided at bottom of the cabinet housing. The bin support comprises a guiding assembly mounted to the frame member. The trash collection apparatus comprises a trash receptacle placed on the bin support and a lid hingedly mounted to the trash receptacle. The bin support carrying the trash receptacle is slidable along the rail with the help of the spring member. While the bin support is being slid, the lid is operated to provide access to interior of the trash receptacle or to cover the trash receptacle and the door is operated between open and closed position.

Various features and embodiments of a trash collection apparatus are explained in conjunction with the description of FIGS. 1-10.

Figure 1:
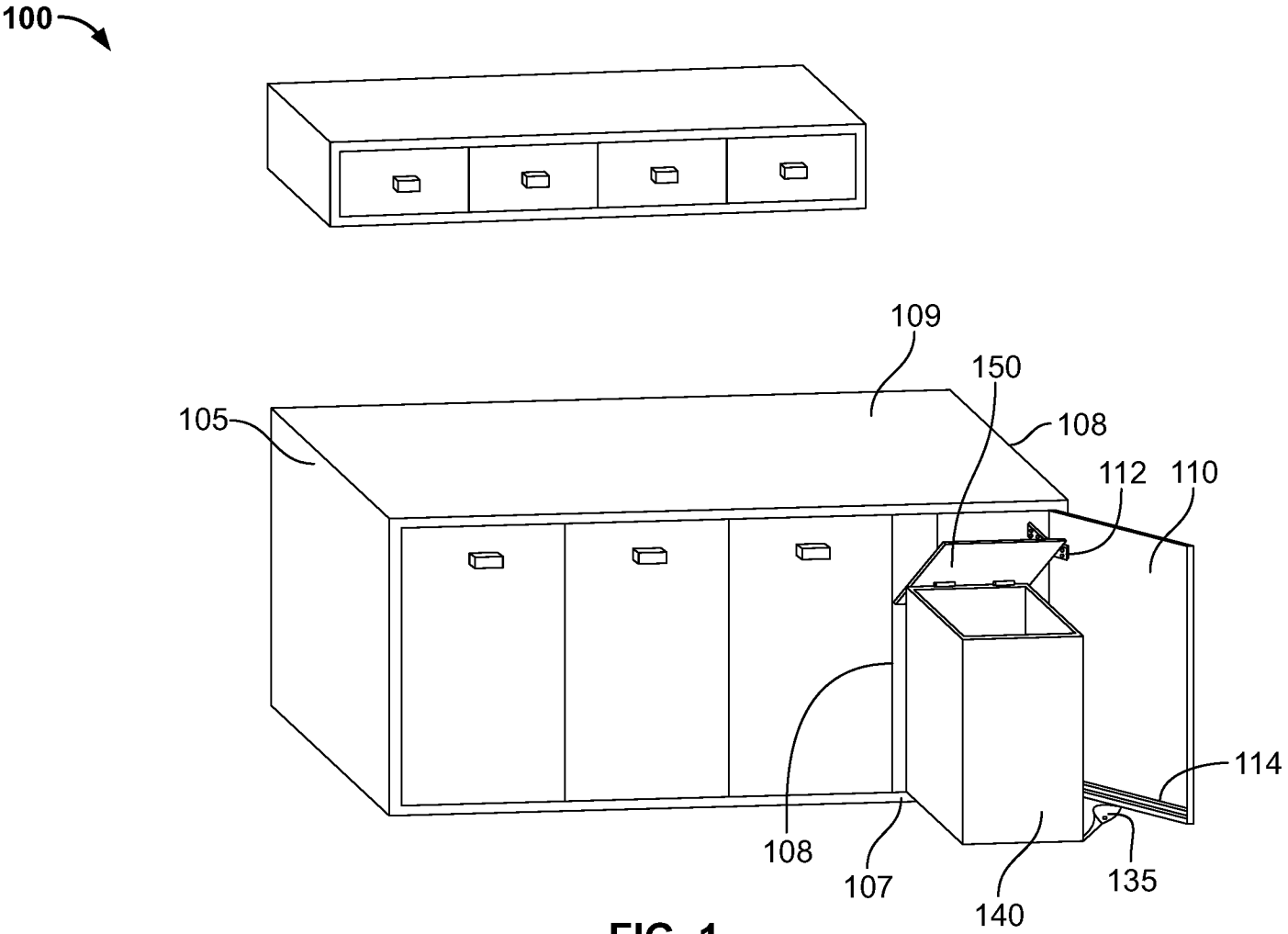
FIG. 1 illustrates a perspective view of a trash collection apparatus 100, in accordance with one embodiment of the present invention.

Referring to FIGS. 1-6, 9 and 10, a trash collection apparatus 100 is shown, in accordance with one embodiment of the present disclosure. Referring to FIG. 1, the trash collection apparatus 100 provided in a kitchen is shown. However, it should be understood that the trash collection apparatus 100 might also be provided in a bathroom, a bedroom, or any other room. As can be seen, the trash collection apparatus 100 comprises a cabinet housing 105. The cabinet housing 105 may include one or more cabinets made up of wooden, plastic, metal or other material. The cabinet housing 105 may include cabinets provided in a series or one above another or in any other configuration.

The cabinet housing 105 comprises a cabinet bottom 107, sidewalls 108 and a countertop 109. The countertop 109 may indicate a top plate placed on the sidewalls 108. The cabinet housing 105 may further comprise a door 110. The door 110 may be made up wooden, plastic, metal or other material. It should be understood that the cabinet bottom 107, the sidewalls 108, the countertop 109 and the door 110 form a closed structure.

Figure 2:
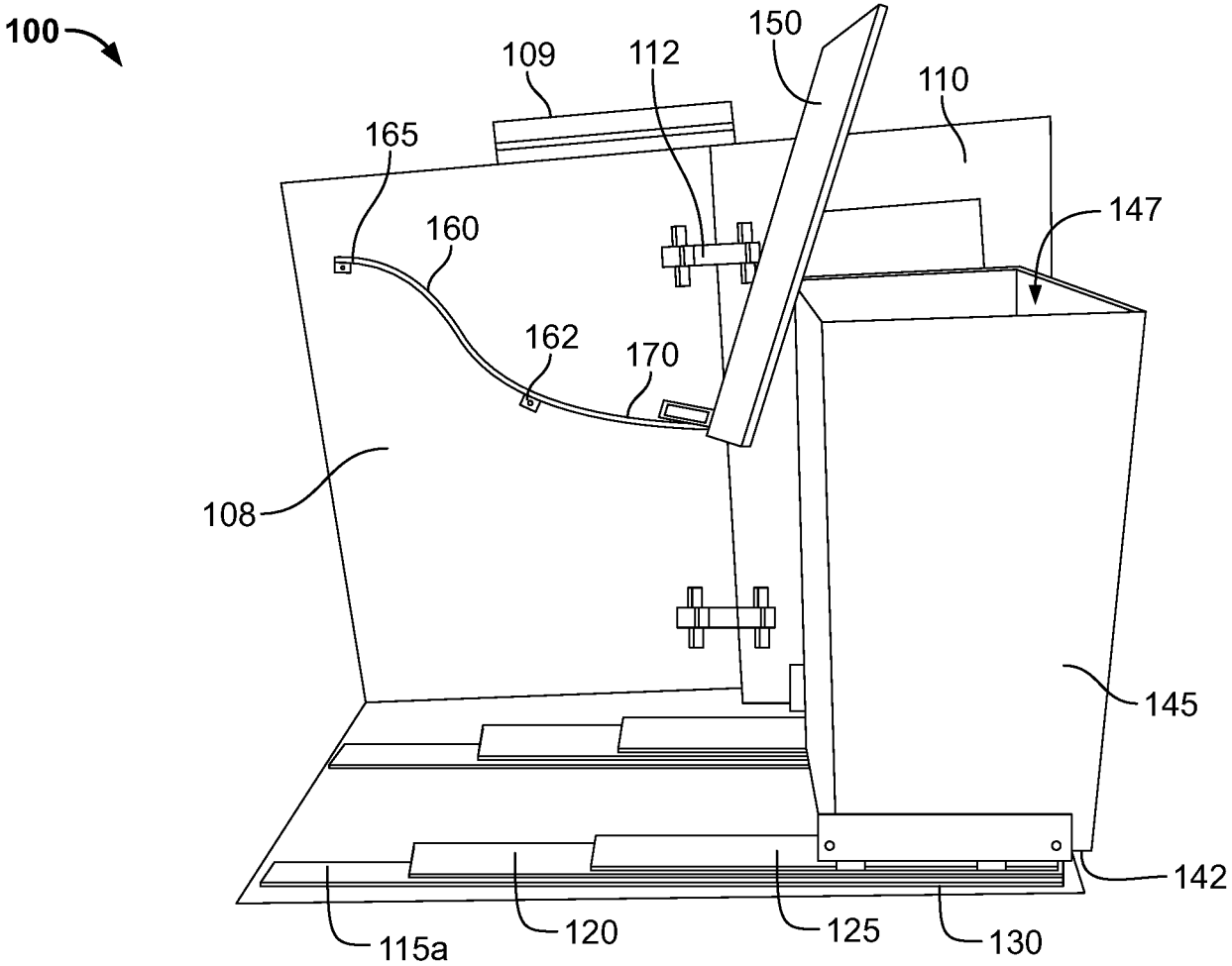
FIG. 2 illustrates the trash collection apparatus 100 in open position, in accordance with one embodiment of the present invention.
Figure 4:
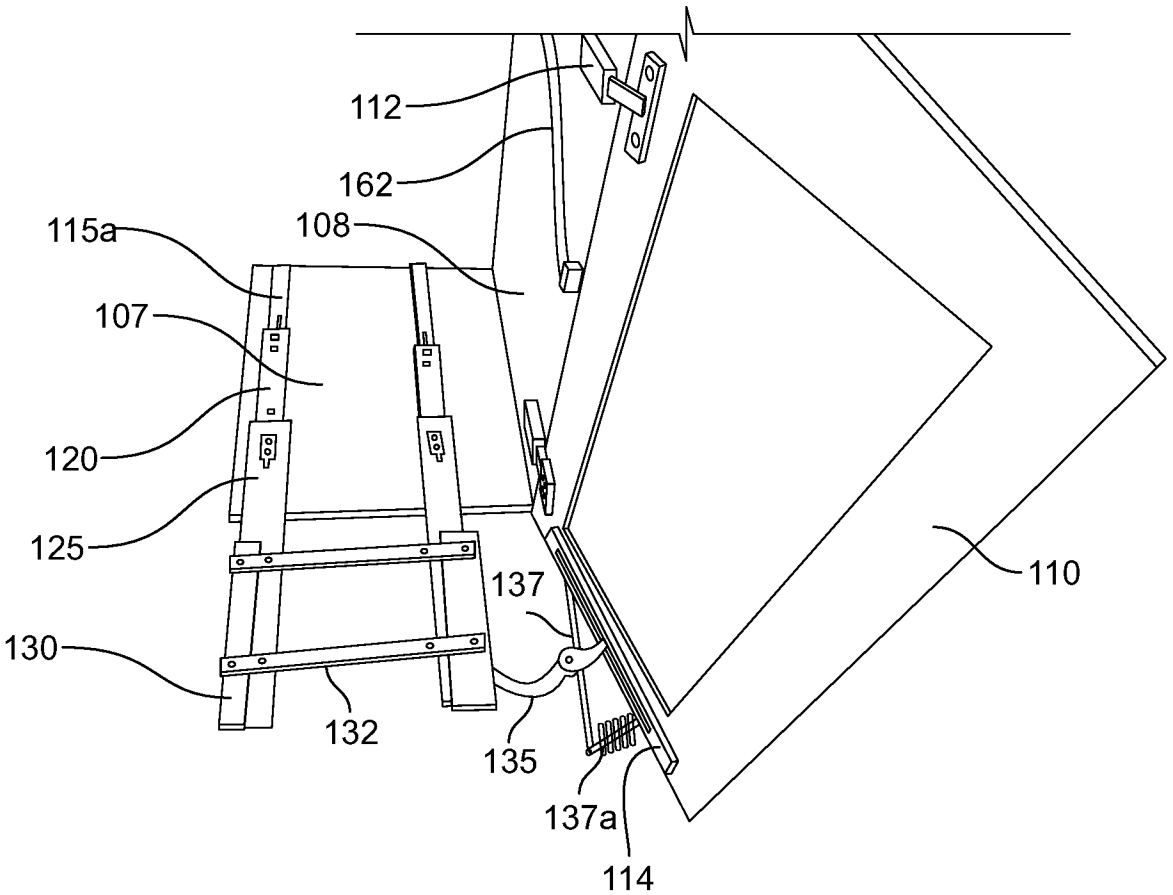
FIGS. 4 and 5 illustrate a bin support 130 provided at cabinet bottom 107 of a cabinet housing 105 in extended and contracted position, respectively, in accordance with one exemplary embodiment of the present invention.

As can be seen in FIGS. 1, 2 and 4, the door 110 is hingedly mounted to one of the sidewalls 108 of the cabinet housing 105 with the help of first hinges 112. The door 110 comprises a frame member 114 provided at the bottom as shown in at least FIGS. 1 and 4. The frame member 114 may made up of metal and preferably mounted to the door 110 at the bottom of door 110 horizontally to the ground.

Now referring to FIGS. 2, 3, 4, 5, and 9 the trash collection apparatus 100 comprises a rail 115*a* provided at the cabinet bottom 107 of the cabinet housing 105. It should be understood that the current embodiment is explained considering that there are two rail 115*a* provided at the cabinet bottom 107 of the cabinet housing 105. However, a person skilled in the art will understand that more than one rail 115*a* may be provided at the cabinet bottom 107. It should be understood that the rail 115*a* is mounted to cabinet bottom 107 using known mechanisms such as fasteners or welding. Each of rail 115*a* is provided with a first spring member 120. The first spring member 120 is slidably mounted to the rail 115*a*. Further, the first spring member 120 is mounted to a second spring member 125. The second spring member 125 is slidably mounted to the first spring member 120.

Bin support 130 may indicate a support base made up of metal or any other suitable material. First spring member 120 is within an inner carriage and a second spring 125 is within an outer carriage. In one embodiment, support structures 132 can be mounted directly to the outer carriages instead of bin support 130.

Figure 5:
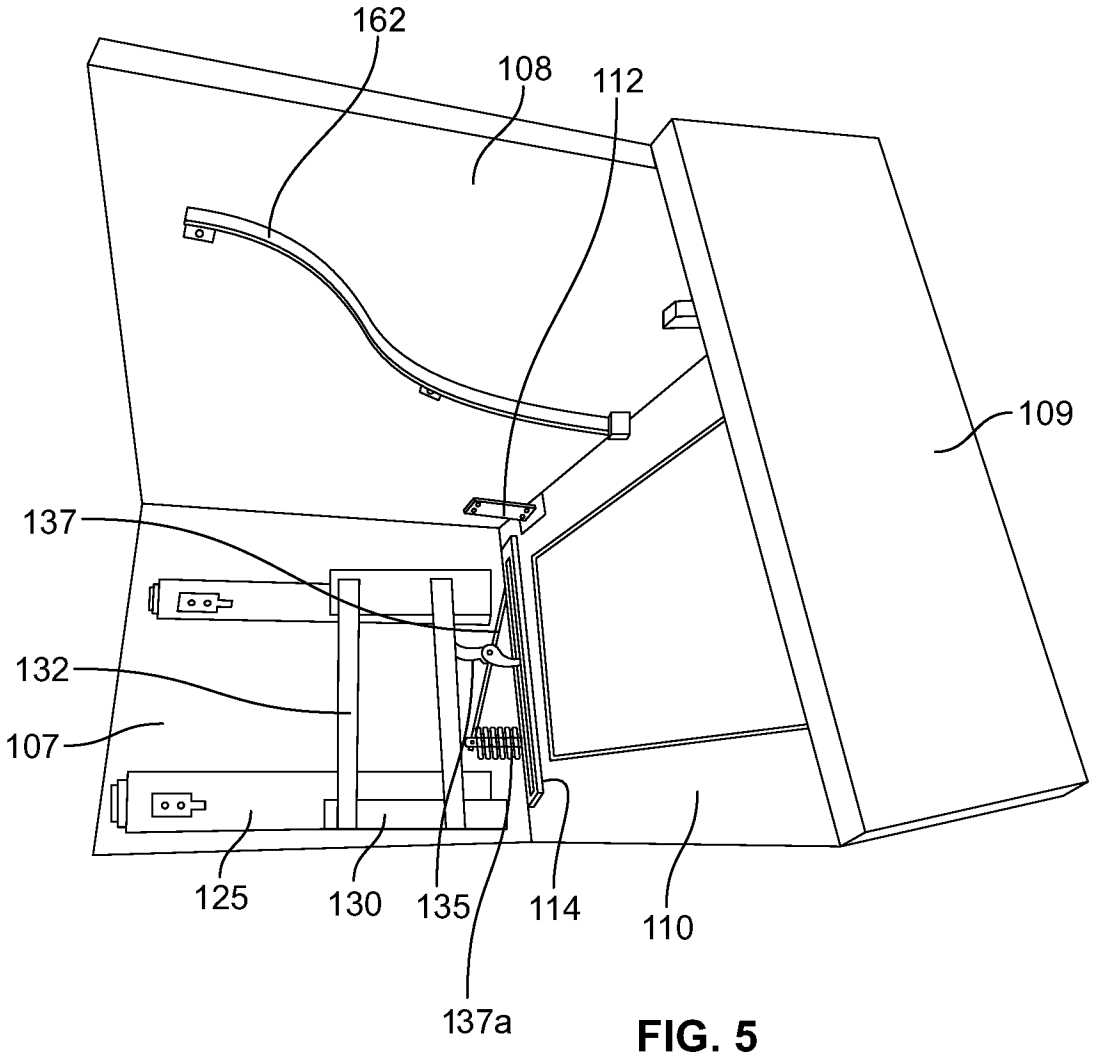

Referring to FIGS. 1, 4 and 5, trash collection apparatus 100 is provided with a guiding assembly 135 under the bin support 130. The guiding assembly 135 can also be mounted to the outer carriage and may be made up of metal or any other suitable material. It should be understood that one end of the guiding assembly 135 is mounted to first wheel 135*a*.

A guiding rod 137 is mounted to frame member 114. Wheel 135*a* travels along guiding rod 137 as door 110 is being closed. Arm 135*c* is mounted to the outer carriage on one end and to joint 135*b* on its opposite end. As door 110 closes arm 135*c* collapses inwardly, until wheel 135*a* comes into contact with guiding rod 137. A guiding rod spring 137*a* can be included to act as a suspension for guiding rod 137 as the force created when door 110 is closed is translated to guiding rod 137 from arm 135*c*. The traveling of wheel 135*a* along guiding rod 137 guides the trash receptacle 140 back inside the cabinet. Door carriage 115 is mounted against door 110. Guiding rod mounting member 116 can be mounted adjacent to and/or parallel with door carriage 115. Guiding rod spring 137*a* is mounted to guiding rod mounting member 116 on one end and to guiding rod 137 on its opposite end. The opposite side of guiding rod 137 is mounted directly to guiding rod mounting member 116. The location where guiding rod 137 is mounted to guiding rod mounting member 116 is predetermined based on the dimensions of the trash receptacle 140 and the amount that the outer rails in the cabinet have to travel to put the trash receptacle 140 back therein.

Door carriage 115 is mounted within a frame member 114 that allows it to slide towards and away from the cabinet. Guiding assembly 135 includes a guiding assembly mounting member 136 that is also mounted to door carriage 115 based on the distance that the trash receptacle 140 must travel to be stored within the cabinet. Guiding assembly mounting member 136 includes a first axis member 136*a* and guiding assembly mounting member 136 is connected to joint 135*b* that can include an adjusting member 135*d* that can modulate the distance joint 135*b* must travel before making contact with door carriage 115. Joint 135*b* is rotatably mounted to arm 135*c* that can include a curved or arched configuration and is in turn rotatably connected to base 138. First wheel 135*a* can be mounted to a distal end of base 138. A second axis member 136*b* is located at joint 135*b* to permit rotation between arm 135*c* and joint 135*b*. A third axis member 136*c* is located at base 138 that allows for the further rotation of arm 135*c*. Rail 115*a* includes a propulsion spring 117 mounted therein.

When door 110 is opened entirely and a user wishes to close the door 110 and push the trash receptacle 140 back in, the first motion will be for the bin support 130 to come into contact with propulsion spring 117. Then joint 135*b* rotates towards bin support 130 using first axis member 136*a*. Arm 135*c* is urged outwardly using second and third axis member 136*b* and 136*c*. Simultaneously, propulsion spring 117 is being compressed until joint 135*b* engages bin support 130 sufficiently to have enough counter force to have arm 135*c* push against base 138 so that the bin can begin moving towards the inside of the cabinet. Once the bin has been inserted a predetermined distance the counter force provided by propulsion spring 117 is then taken over by wheel 135*a* as it pushes against guiding rod 137. As wheel 135*a* travels along the predetermined angle of guiding rod 137, joint 135*b* is lifted off bin support 130 and rotated inwardly as arm 135*c* continues to push base 138 and in turn the bin towards the inside of the cabinet. Once joint 135*b* reaches its maximum inward rotation, it then pulls bin support 130 along rail 115*a* towards the cabinet to satisfy the entire travel distance necessary to push the trash receptacle 140 back into the cabinet. Wheel 135*a* continues to travel the length of the guiding rod 137 to continue providing base 138 with the force it needs to continue being urged inside the cabinet. When door 110 is opened first and second spring member 120 and 125 urge the bin out of the cabinet and wheel 135*a* travels the opposite way along guiding rod 137.

Lid actuating assembly 160 includes a slide 162 that includes a path that cooperates with the size of lid 150. Slide 162 can include a first portion 162*a* that is curved so that when the lid 150 is opened or overextended it does not fall off slide 162. Slide 162 includes a second portion 162*b* that can be substantially linear and its length is determined based on the distance roller 157 has to travel to close lid 150. Roller 157 can be mounted to the back of lid 150 so it is raised as it travels up slide 162 thereby lowering the front of lid 150 thus closing it. Upon base 138 being pushed inside the cabinet using the counter force of the propulsion spring 117, roller 157 begins to travel. Once the lid 150 is closed the bin may still be pushed inside thus a third portion 162*c* is needed and it must be horizontal since it is no longer necessary to lift the back of lid 150 since it is closed.

The trash receptacle 140 as may indicate a trash bin or a container used for receiving trash or any other objects. The trash receptacle 140 may be made up of plastic, metal or any other suitable material. The trash receptacle 140 comprises a bottom 142 and upstanding sidewalls 145 defining an opening 147. The upstanding sidewalls 145 may be provided in perpendicular or slantly to the bottom 142 of the trash receptacle 140.

Figure 6:
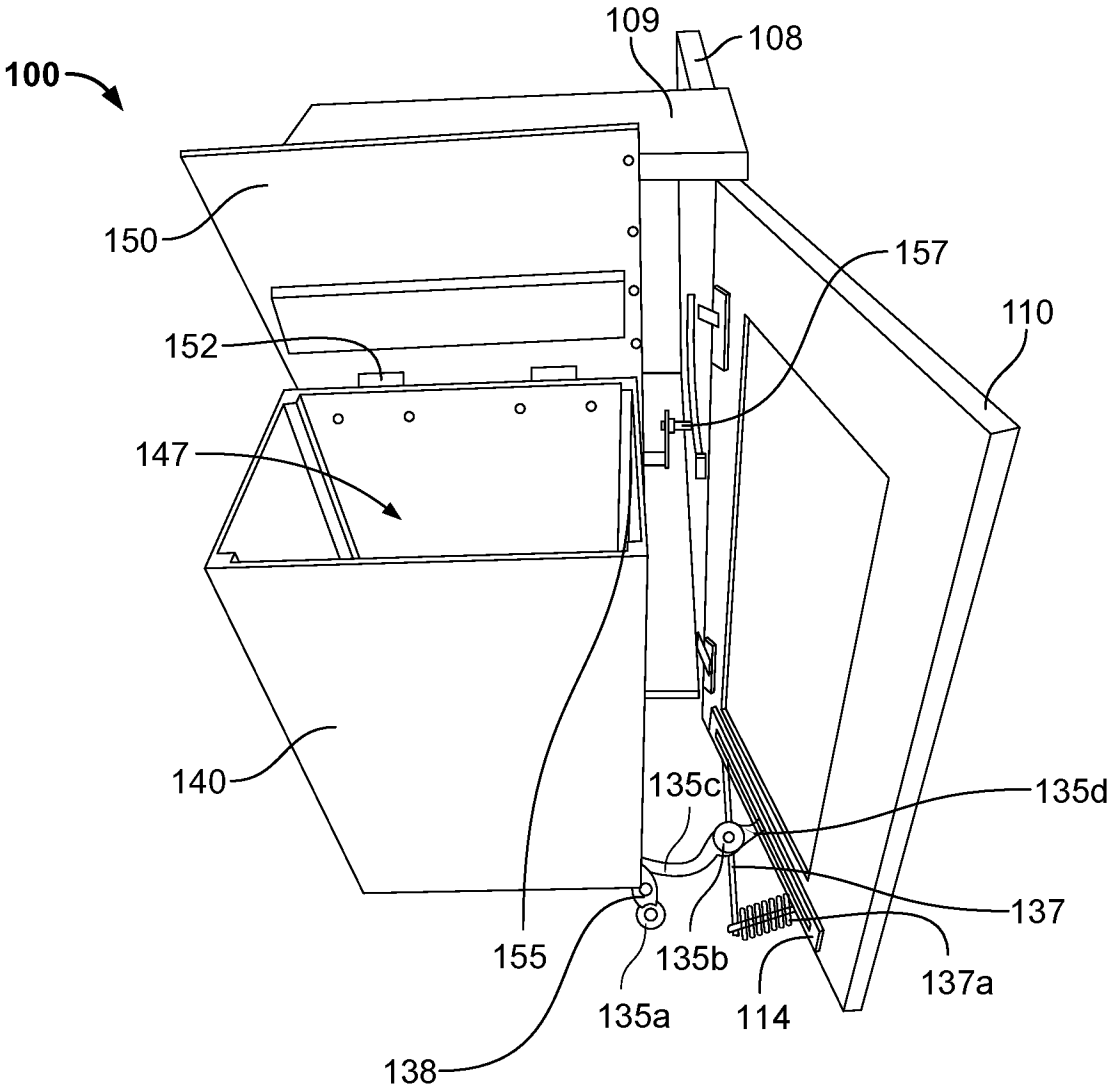
FIG. 6 illustrates a front view of the trash collection apparatus 100, in accordance with one embodiment of the present invention.
Figure 7:
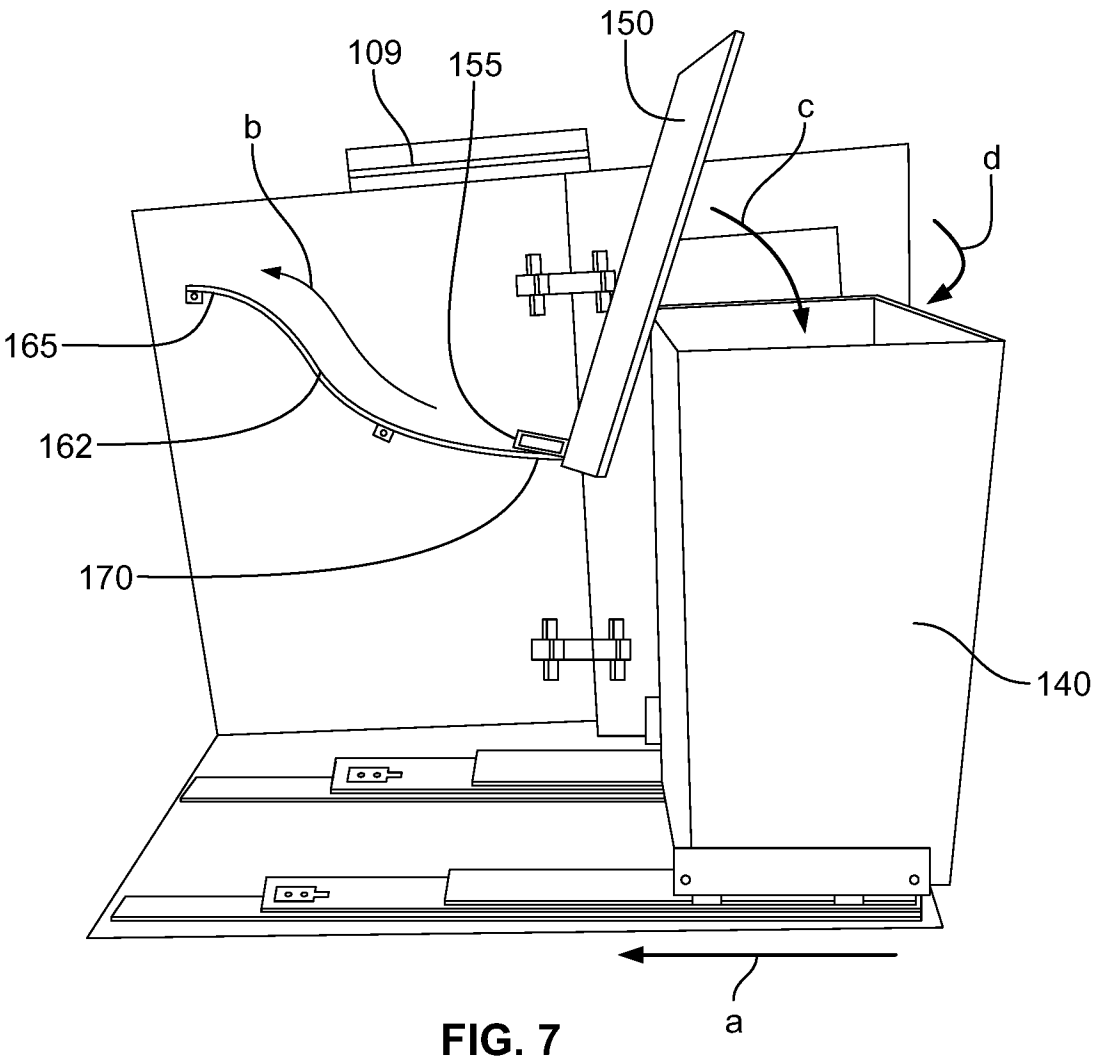
FIGS. 7 and 8 illustrate operation of the trash collection apparatus 100, in accordance with one embodiment of the present invention.
Figure 9:
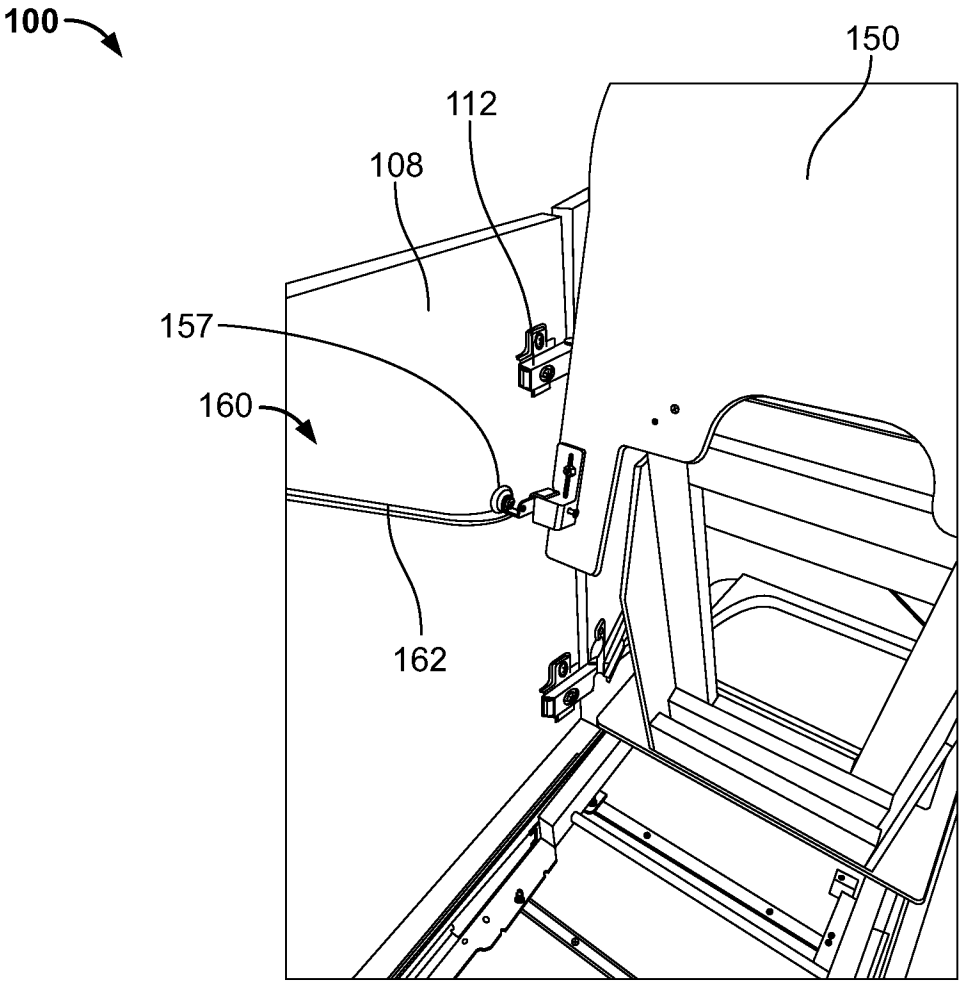
FIG. 9 illustrates a rear view of a lid 150 in raised position, in accordance with one embodiment of the present invention.
Figure 10:
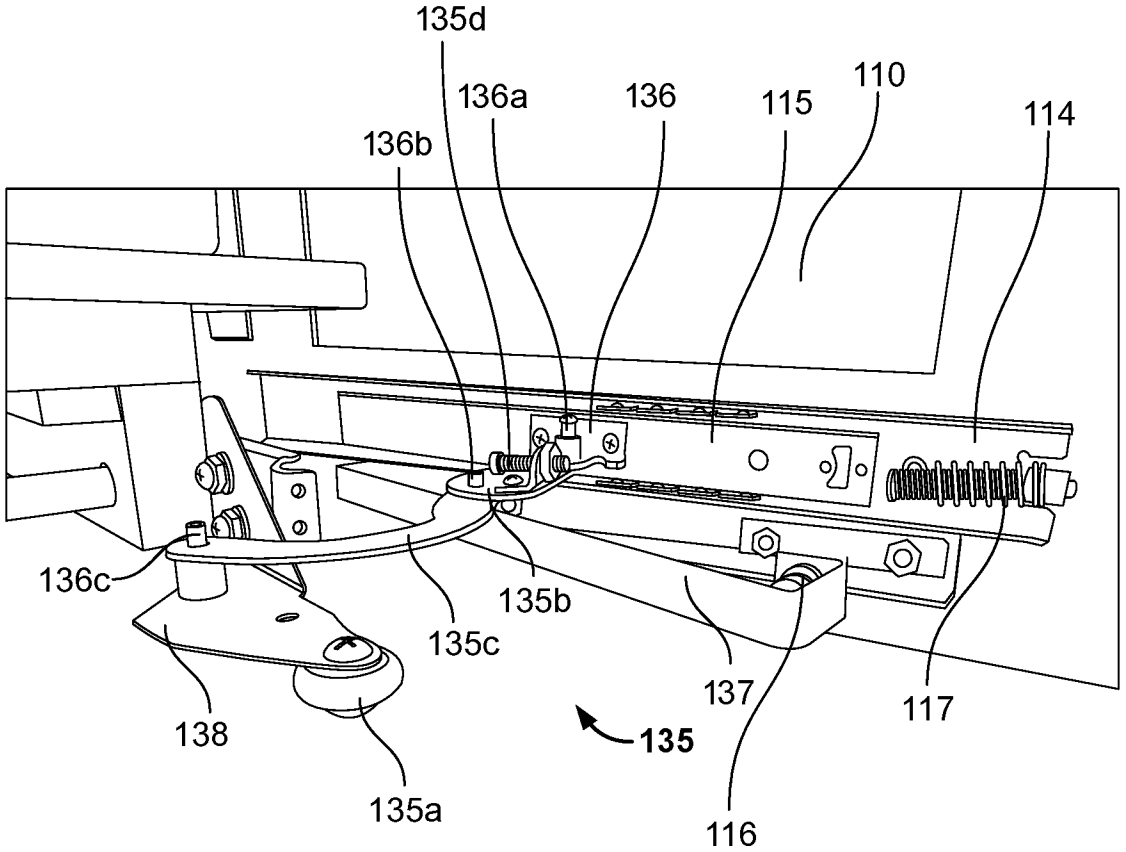
FIG. 10 illustrates a guiding assembly 135 used to operate a door 110 of trash collection apparatus 100, in accordance with one embodiment of the present invention.

Further, the trash receptacle 140 comprises a lid 150 mounted to one of the upstanding sidewalls 145 with the help of second hinges 152. The lid 150 comprises a support arm 155 extending from the lid 150. The support arm 155 comprises a roller 157, as shown in FIGS. 6 and 7. It should be understood that FIG. 6 shows a front view of the trash collection apparatus 100 in which the lid 150 is in raised position and FIG. 9 shows a rear or inside view of the trash collection apparatus 100 in which the lid 150 is in raised position.

Figure 3:
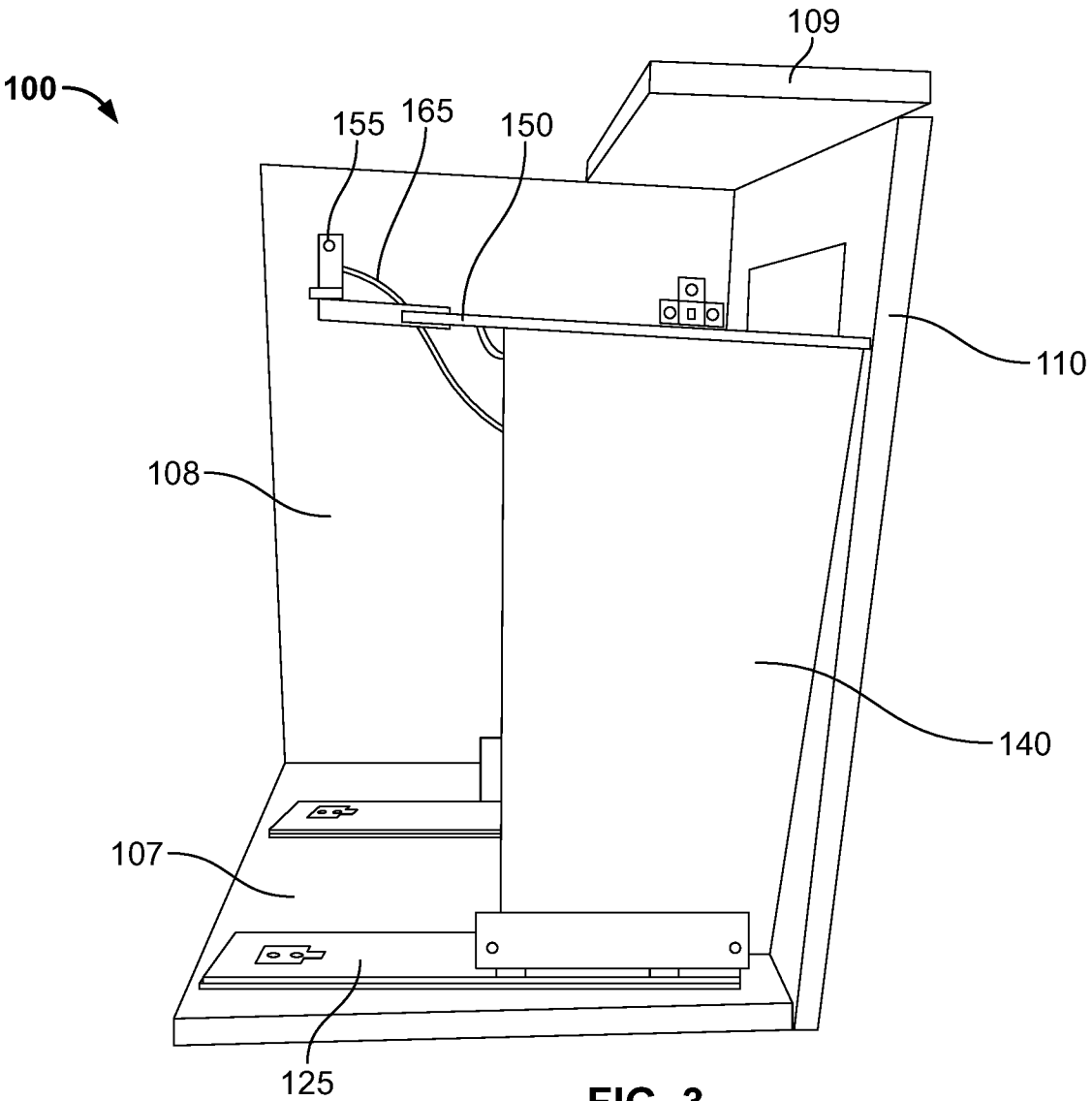
FIG. 3 illustrates the trash collection apparatus 100 in closed position, in accordance with one embodiment of the present invention.

As can be seen in at least FIGS. 2, 3 and 6, the trash receptacle 140 is placed on the bin support 130. The trash receptacle 140 may be mounted to the bin support 130 using known mechanisms such as fasteners or welding. Preferably, the trash receptacle 140 is removably mounted to the bin support 130 using known mechanisms.

Figure 8:
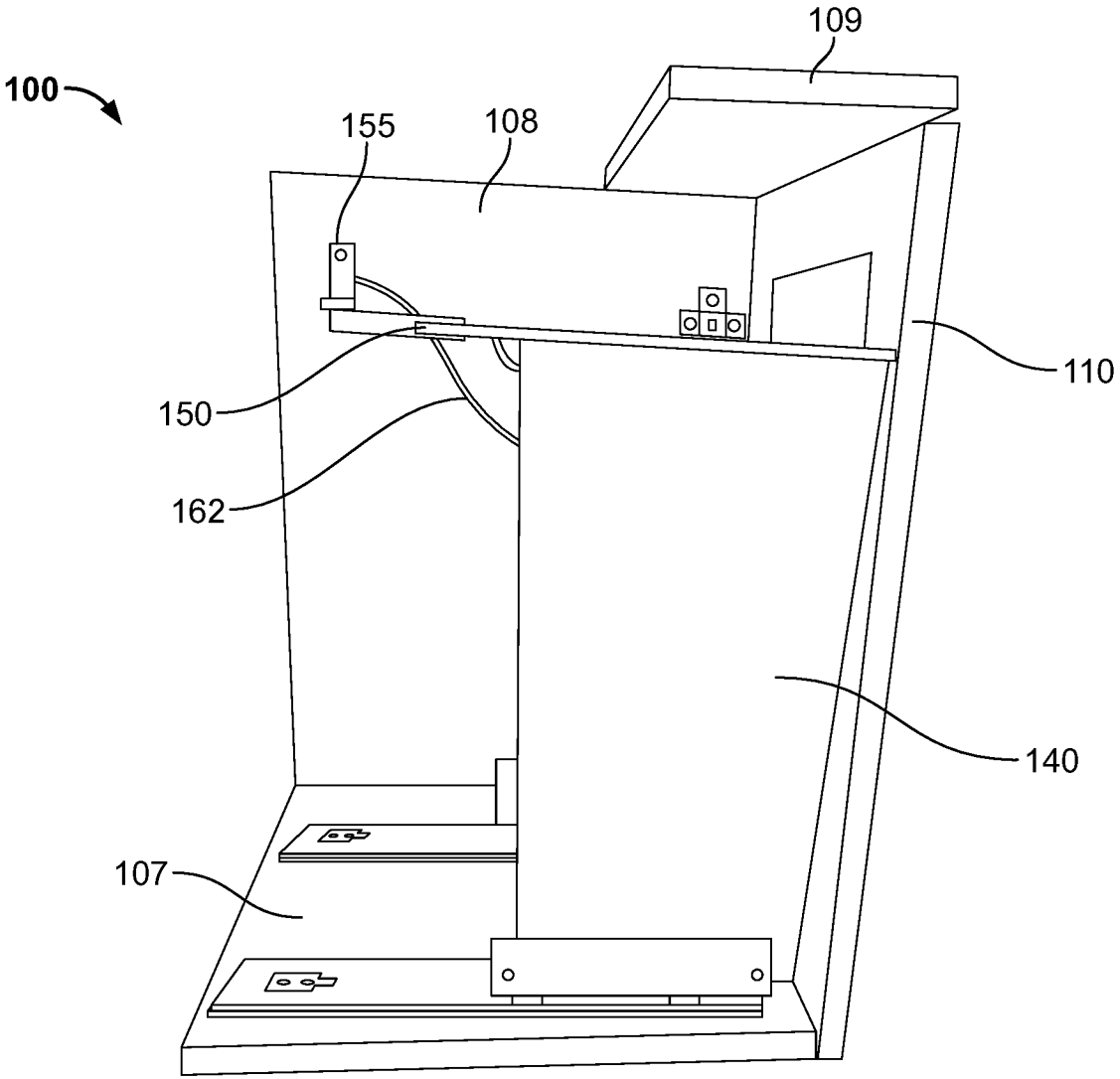

Now referring to FIGS. 7 and 8, operation of the trash collection apparatus 100 is explained, in accordance with one embodiment of the present disclosure. It should be understood that FIG. 7 shows the trash collection apparatus 100 in open position and FIG. 8 shows the trash collection apparatus 100 in closed/retracted position.

It should be understood that the bin support 130, the roller 157, the lid 150 and the door 110 are operated in synchronization such that when the trash receptacle 140 is retrieved into the cabinet housing 105, the bin support 130 carrying the trash receptacle 140 moves in the first direction a, the roller 157 moves towards the first end 165 of the track 160 in the second direction b, the lid 150 is lowered in the third direction c, and the door 110 is made to swing in the fourth direction to close the cabinet housing 105 simultaneously.

Similarly, when the trash receptacle 140 needs to be accessed, the user may pull the door 110. When the door 110 is pulled i.e., the door 110 moves from closed position to open position (as shown in FIG. 7), the bin support 130 is pulled with the help of the guiding assembly 135. When the bin support 130 is pulled, the bin support 130 pulls the second spring member 125, which in turn pulls the first spring member 120 thereby extending the trash receptacle 140 from the cabinet housing 105. While the bin support 130 is being pulled, the roller 157 is made to move from the first end 165 to the second end 170 of the lid actuating assembly 160 thereby raising/tilling the lid 150 in order to access interior of the trash receptacle 140. It should be noted that the door 110, the bin support 130, and the lid 150 (i.e., the roller 157 from the first end 165 to the second end 170 on the lid actuating assembly 160) are operated simultaneously.

Based on the above, it is evident that the waste receptacle is configured to move forward and open a lid when a door of the cabinet housing is opened to collect waste and to retrieve to its original position while closing the lid and closing the door simultaneously.

The trash collection apparatus can be provided in a kitchen, a bedroom, a bathroom, retail stores or any other places.

It is obvious to a person skilled in the art to provide the trash collection apparatus in various configurations based on the need.

Further, it is understood that the trash collection apparatus discloses a simpler mechanism to access the trash receptacle using sliding mechanism. Further, the trash collection apparatus utilizes a unique track in curved shape provided at the sidewall of the cabinet housing for raising and lowering the lid automatically when the trash receptacle is drawn out or retracted into the cabinet housing. Furthermore, the guiding assembly is positioned in a such that it is easy to open or close the door when the trash receptacle is drawn out or retracted into the cabinet housing.

It should be understood that the shape and size of the trash collection apparatus illustrated in drawings is provided for illustrative purpose only and should not construed in limited sense. A person skilled in the art will appreciate various aspects described herein with modifications.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A trash collection apparatus, comprising:

a frame member adapted to being mounted to a cabinet door, a door carriage is mounted within said frame member;

a bin support mounted to at least one spring member, wherein the at least one spring member is mounted to a rail provided at a bottom of a cabinet;

a guiding assembly provided at said bin support, wherein said guiding assembly is mounted to said frame member;

said guiding assembly includes a guiding rod, wherein said guiding rod is connected to a guiding rod spring;

a trash receptacle placed on said bin support;

a lid hingedly mounted to said trash receptacle;

said bin support carrying said trash receptacle is slidable along said rail with the help of a propulsion spring adapted to slide said bin support along said rail; and a lid actuating assembly, said lid includes a support arm having a roller, said roller travels on said lid actuating assembly to raise or lower said lid when said bin support is slid along said rail.

2. The trash collection apparatus of claim 1, wherein said lid actuating assembly is mounted on one of sidewalls of said cabinet.

3. A trash collection apparatus, comprising:

a cabinet housing;

a cabinet bottom;

sidewalls, wherein one of said sidewalls comprises a lid actuating assembly;

a counter top;

a door hingedly mounted to said cabinet housing at one of said sidewalls, wherein said door includes a frame member;

a bin support mounted to at least one spring member, wherein said at least one spring member is mounted to a rail provided at said cabinet bottom, wherein said at least one spring member facilitates in extending and contracting the length of said bin support, and wherein said bin support further includes a guiding assembly mounted to said frame member provided at said door;

a trash receptacle placed on the bin support;

a lid hingedly mounted to said trash receptacle, wherein said lid includes a support arm having a roller, wherein said roller is placed on said lid actuating assembly having a slid, provided at one of said sidewalls of said cabinet housing, wherein said bin support is slidable along said rail with the help of the one spring member such that said trash receptacle is slid along with said bin support, wherein when said bin support carrying said trash receptacle is slid away from said cabinet housing, said roller is made to travel over said lid actuating assembly in order to raise said lid to provide access to interior of said trash receptacle;

said guiding assembly pushes said door from closed position to open position in order to access said trash receptacle, when said bin support carrying said trash receptacle is slid into the cabinet housing, said roller is made to travel over said lid actuating assembly in order to lower said lid in order to cover said trash receptacle, and said guiding assembly pulls said door from open position to closed position.

* * * * *